US009194587B2

(12) United States Patent
Prade

(10) Patent No.: US 9,194,587 B2
(45) Date of Patent: Nov. 24, 2015

(54) GAS TURBINE COMBUSTION CHAMBER

(75) Inventor: Bernd Prade, Mülheim (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 481 days.

(21) Appl. No.: 13/813,494

(22) PCT Filed: Jun. 15, 2011

(86) PCT No.: PCT/EP2011/059901
§ 371 (c)(1),
(2), (4) Date: Jan. 31, 2013

(87) PCT Pub. No.: WO2012/016748
PCT Pub. Date: Feb. 9, 2012

(65) Prior Publication Data

US 2013/0125550 A1 May 23, 2013

(30) Foreign Application Priority Data

Aug. 2, 2010 (EP) ..... 10171601

(51) Int. Cl.
*F02C 1/00* (2006.01)
*F23R 3/28* (2006.01)
*F23R 3/34* (2006.01)

(52) U.S. Cl.
CPC .. *F23R 3/28* (2013.01); *F23R 3/343* (2013.01)

(58) Field of Classification Search
CPC ..... F23R 3/28; F23R 3/343
USPC ..... 60/734, 740, 742, 748
See application file for complete search history.

(56) References Cited

U.S. PATENT DOCUMENTS

| | | | | |
|---|---|---|---|---|
| 3,736,746 | A * | 6/1973 | DuBell et al. | 60/804 |
| 5,129,226 | A * | 7/1992 | Bigelow et al. | 60/765 |
| 6,026,644 | A | 2/2000 | Azuhata | |
| 6,038,861 | A | 3/2000 | Amos | |
| 6,122,916 | A | 9/2000 | Amos | |
| 2001/0022088 | A1 | 9/2001 | Gora | |
| 2010/0064691 | A1 * | 3/2010 | Laster et al. | 60/737 |
| 2010/0077760 | A1 * | 4/2010 | Laster et al. | 60/742 |

FOREIGN PATENT DOCUMENTS

| | | | |
|---|---|---|---|
| CN | 1464959 | A | 12/2003 |
| EP | 2187127 | A1 | 5/2010 |
| JP | H07133931 | A | 5/1995 |
| RU | 99596 | U1 | 11/2010 |
| WO | WO 9906767 | A1 | 2/1999 |

* cited by examiner

*Primary Examiner* — Hoang Nguyen

(57) ABSTRACT

A gas turbine combustion chamber is provided including a pilot fuel nozzle arranged in the central section of a cylinder that opens at one end towards a combustion chamber. The pilot fuel nozzle includes a fuel nozzle and a cylindrical outer casing around the outer circumference of the fuel nozzle. A pilot swirl element is arranged between fuel nozzle and outer casing, including a plurality of main burners which are arranged around the pilot fuel nozzle, and including a pilot cone having an inner side and an outer side. The pilot cone is arranged on the pilot fuel nozzle and an opening, such that a pilot flame is formed in the pilot cone by mixing air and pilot fuel in order to ignite a fuel injected by the main burners, wherein the pilot cone has turbulence generators on the inner side and/or outer side thereof.

5 Claims, 3 Drawing Sheets

GAS TURBINE COMBUSTION CHAMBER

CROSS REFERENCE TO RELATED APPLICATIONS

This application is the US National Stage of International Application No. PCT/EP2011/059901, filed Jun. 15, 2011 and claims the benefit thereof. The International Application claims the benefits of European Patent Office application No. 10171601.7 EP filed Aug. 2, 2010. All of the applications are incorporated by reference herein in their entirety.

FIELD OF INVENTION

The present invention relates to a gas turbine combustion chamber as claimed in the claims.

BACKGROUND OF INVENTION

A gas turbine combustion chamber in which premixed combustion takes place is provided with a pilot burner for combustion in addition to the main burners for premixed combustion. The pilot burner serves to stabilize the combustion. The diffusion flame or premixed flame produced by the pilot is used as the pilot flame for the main burner in order to produce a more fuel-rich flame, which stabilizes the combustion. If necessary, a pilot burner can have a cone at the outlet, which facilitates the stabilization of the pilot flame. In such a gas turbine combustion chamber the main burners are arranged at regular intervals around the pilot burner. High performance of such a gas turbine combustion chamber demands high turbine inlet temperatures which result from a high flame temperature. With regard to the development of CO and NOx values, it is necessary to maintain the flame temperature and the dwell time of the gas in the combustion chamber within a permissible range.

The high temperatures in the gas turbine demand a high flame temperature, which also have an effect on the NOx values and increase these values. However, in order to maintain the NOx values within the permissible range, the mean flame temperature in the combustion chamber should be minimized to a permissible value that is adapted to the efficiency, with respect to the developed NOx values. In addition, it would be necessary to reduce the dwell time of the gas in the combustion chamber, for example by means of a shortened combustion chamber.

However, for low NOx values it is likewise necessary to achieve low CO values. However, the CO values increase at a flame temperature of below 1300° C. Locally restricted volumes in the combustion chamber in which temperatures fall below this lower temperature limit can also have a dominant effect on increased emissions of CO. In order to keep CO to a low value, good intermixing is necessary. However, for this it is necessary to increase the dwell time or the mixing length of the gas in the combustion chamber, for example by lengthening the combustion chamber. However, this is in contradiction to a shortening of the dwell time for reduction of the NOx values.

Furthermore, however, in order to maintain the NOx values within the permissible range, measures could be taken, for example preheating or even reducing the compressed air which is fed to the combustion chamber, or even modifying the supply system, at least partially, in order to direct it around the combustion chamber. This would, however, have a detrimental effect on the operation of the turbine under base load. In addition, manufacturing costs would increase as a result.

Moreover, the availability of the machine could be restricted, which likewise would be a serious disadvantage.

SUMMARY OF INVENTION

The object of the present invention is therefore to state a gas turbine combustion chamber which can be operated at an increased flame temperature and thus improved efficiency and without the disadvantages described above.

The problem is achieved with a gas turbine combustion chamber as claimed in the claims. The further subclaims contain advantageous embodiments of the invention.

Due to the turbulence generators, in particular on the inner side and/or the outer side of the pilot cone, improved intermixing between the pilot mixture developed in the pilot cone and the main mixture produced via the main burner, is obtained downstream of the pilot cone Improved combustion of the resulting pilot/main mixture is therefore produced downstream of the pilot cone. As a result, a reduction of the dwell time and a shortening of the mixing length of the gas in the combustion chamber is possible without increasing the CO values. Consequently, low NOx values are achieved even at high flame temperatures. As a result, measures for reducing NOx values can be dispensed with. Moreover, due to the reduction of cold, locally limited volumes in the combustion chamber, the stable operating range can be extended to a lower mean temperature with low CO emissions.

BRIEF DESCRIPTION OF THE DRAWINGS

Further advantages, features and characteristics of the present invention are described in further detail below with the aid of exemplary embodiments with reference to the accompanying figures. In this case the features of the exemplary embodiments can be advantageous individually or in combination with each other.

DETAILED DESCRIPTION OF INVENTION

Figure 1:
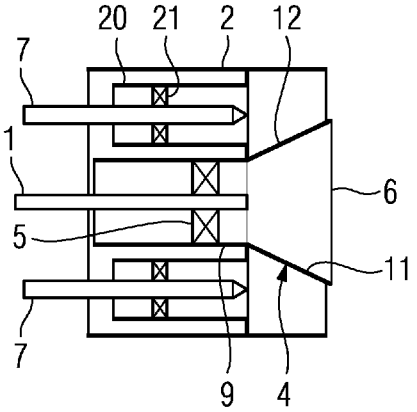
FIG 1 (Prior art)
FIG. 1 shows a schematic, longitudinal section through a gas turbine combustion chamber according to the prior art.
Figure 2:
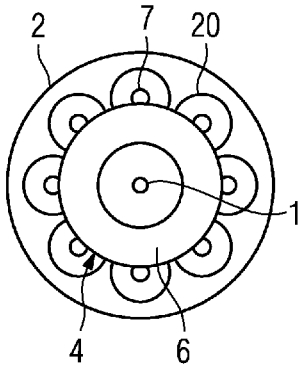
FIG 2 (Prior art)
FIG. 2 shows a schematic, cross-section perpendicular to the longitudinal section, through a gas turbine combustion chamber according to the prior art.

FIG. 1 and FIG. 2 show a gas turbine combustion chamber according to the prior art. Here the gas turbine combustion chamber has a pilot fuel nozzle which is arranged in the central section of a cylinder 2. The cylinder 2 opens at one end towards a combustion chamber (not shown). The pilot fuel nozzle contains a fuel nozzle 1 and a cylindrical outer casing 9 around the outer circumference of the fuel nozzle 1 and at a radial distance therefrom. A pilot swirl element 5 is arranged between fuel nozzle 1 and outer casing 9. A pilot cone 4 with inner side 11 and outer side 12 is arranged on the pilot fuel nozzle at the combustion chamber end. The pilot cone 4 has an opening 6 inside the front area of the cylinder 2. A plurality of main burners is arranged around the pilot fuel nozzle with respect to the radial direction. Each main burner has a main nozzle 7 and an outer cylinder 20 arranged with a gap around the outer circumference of the relevant main nozzle 7. In addition, main swirl elements 21 are arranged in the gap. By mixing fuel with air, such a main burner produces a main mixture which is ejected by the main burner towards the combustion chamber (not shown).

Due to the mixing of air and pilot fuel, a mixed pilot flame (pilot mixture) is developed in the pilot cone 4, so that the fuel present in the mixture coming from the main burners is ignited and therefore the mixture (main mixture) coming from the main burner is combusted.

Figure 3:
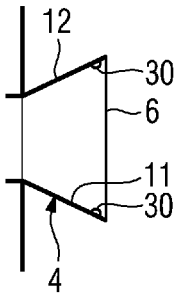
FIG. 3 shows a schematic, side view of the inventive pilot cone in a first exemplary embodiment.
Figure 4:
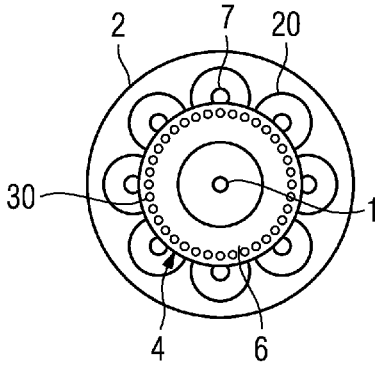
FIG. 4 shows a schematic, cross-section perpendicular to the longitudinal section, through the inventive gas turbine combustion chamber of the first exemplary embodiment.

FIG. 3 and FIG. 4 now show a first exemplary embodiment of the invention. In order to improve the intermixing between the fuel-rich pilot mixture flowing out from the pilot cone 4 towards the combustion chamber and the fuel-lean main mixture coming from the main burner, turbulence generators in the form of projections are placed on the inner side 11 of the pilot cone 4 (FIG. 3 and FIG. 4). These are predominantly located in the area of the opening 6 of the pilot cone 4. The projections 30 can also be placed on the outer side 12 of the pilot cone 4 (not shown). In this case the projections 30 are preferably placed at regular intervals over the entire circumference of the opening 6 of the pilot cone 4 (FIG. 4). Dimples or depressions (not shown) can also be inserted instead of the projections 30. The turbulence generators produce better intermixing and therefore improved CO values. As a result, good NOx values are obtained with high flame temperatures, even with a short dwell time and a short mixing length of the combustion gas in the combustion chamber (not shown). Other measures for reducing the NOx values can therefore be dispensed with. As a result there is no longer any impairment of the operation, for example in base load.

Figure 5:
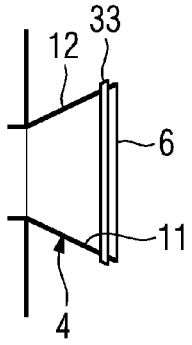
FIG. 5 shows a schematic, side view of an inventive pilot cone in a second exemplary embodiment.

FIG. 5 now shows a second exemplary embodiment of the invention. Here a single strip ring 33 is provided as turbulence generator, which is arranged over the entire circumference of the outer side 12 in the area of the opening 6 of the pilot cone 4. Alternately (not shown), strips can also be provided and arranged at a distance from each other over the circumference of the outer side 12 in the area of the opening 6 of the pilot cone 4. The strip ring 33 is arranged at an angle of between 30° C. and 60° C. to the outer side 12 of the pilot cone 4. Likewise, the strips (not shown) can be arranged at such an angle. This results in particularly good intermixing of the pilot mixture and main mixture and therefore particularly good combustion.

Figure 6:
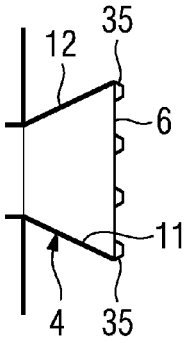
FIG. 6 shows a schematic, side view of an inventive pilot cone in a third exemplary embodiment.
Figure 7:
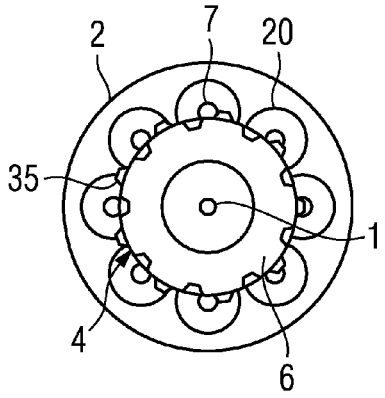
FIG. 7 shows a schematic, cross-section perpendicular to the longitudinal section, through the inventive gas turbine combustion chamber of the third exemplary embodiment.

FIG. 6 and FIG. 7 now show a third exemplary embodiment of the invention. Here the turbulence generators are embodied as trapezoidal strips 35 which are arranged at the opening 6 over the entire circumference of the opening 6, with the trapezoidal strips 35 being alternately arranged at an angle of −/+30° C. on the pilot cone 4. The intermixing of the pilot mixture and main mixture can also be significantly enhanced in this way.

Turbulence generators can also be blades, corners or prisms with a sharp, straight edge, which are arranged (not shown) at a predetermined angle over the entire circumference of the opening 6 of the pilot cone 4. In this case the sharp edge faces the combustion chamber (not shown). Such blades can likewise be arranged alternately at different angles (not shown), in particular, at an angle of +/−30° C., on the pilot cone 4.

Figure 8:
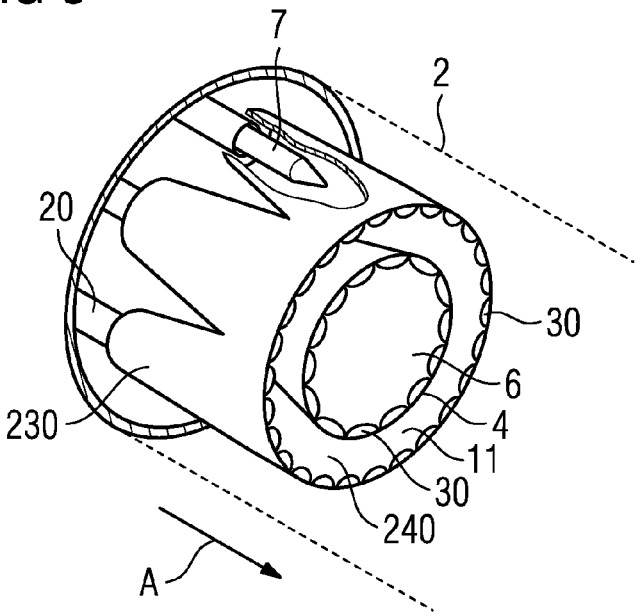
FIG. 8 shows a schematic, longitudinal section through an inventive gas turbine combustion chamber in a fourth exemplary embodiment.

FIG. 8 shows a further exemplary embodiment of an inventive gas turbine combustion chamber. The gas turbine combustion chamber has an axial direction A. Each of the main burners has in addition main nozzles 7 and an outer cylinder 20 arranged with a gap around the outer circumference of the relevant main nozzle 7. Moreover, extension tubes 230 are embodied so that they extend the openings of the outer cylinder 20, that is to say the extension tubes 230 have a radial taper and widen out in the circumferential direction, so that each extension tube 230 merges into the adjacent extension tube 230. This results in an annular main nozzle opening 240. The annular main nozzle opening 240 is extended in the axial direction A up to the opening 6 of the pilot cone 4. Here turbulence generators, for example projections 30, are arranged on the inner side 11 of the annular main nozzle opening 240. In addition, turbulence generators are placed on the inner side 11 and/or the outer side 12 of the pilot cone 4. This produces better intermixing and therefore improved CO values compared to such a gas turbine configuration without turbulence generators.

Figure 9:
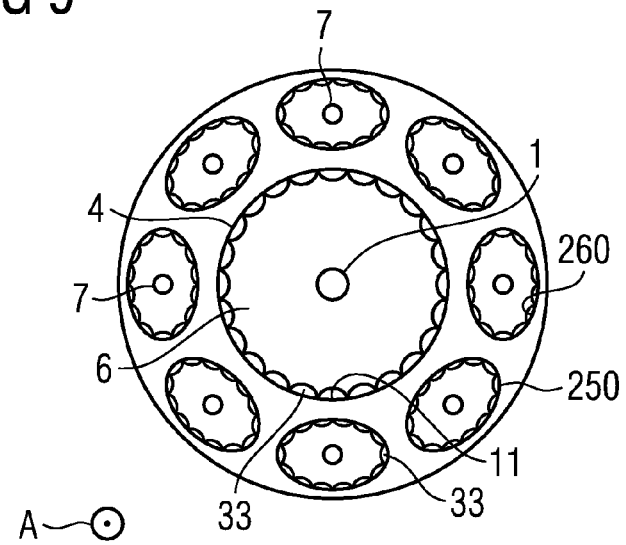
FIG. 9 shows a schematic, cross-section perpendicular to the longitudinal section, through an inventive gas turbine combustion chamber in a fifth exemplary embodiment.

FIG. 9 shows a fifth example of an inventive gas turbine combustion chamber. This has an axial direction A. Each of the main burners has main nozzles 7 and an outer cylinder 20 (FIG. 8) arranged with a gap around the outer circumference of the relevant main nozzle 7. There are extension tubes 250 with an outlet opening at the combustion chamber end, which are embodied in such a way that they extend the opening of the outer cylinder 20 (FIG. 8) in the axial direction A up to the opening 6 of the pilot cone 4. In this case, turbulence generators, for example projections 30, are arranged on an inner side 260 of the extension tubes 250 in the area of the outlet opening of the extension tubes 250. In addition, turbulence generators are located on the inner side 11 and/or outer side 12 of the pilot cone 4. This produces better intermixing and therefore improved CO values compared to such a gas turbine configuration without turbulence generators.

The invention claimed is:

1. A gas turbine combustion chamber comprising:

a pilot fuel nozzle arranged in a central section of a cylinder which opens at one end towards a combustion chamber, the pilot fuel nozzle comprises:

a fuel nozzle and a cylindrical outer casing around the outer circumference of the fuel nozzle and at a radial distance therefrom, a pilot swirl element arranged between fuel nozzle and outer casing; and a pilot cone having an inner side and an outer side, wherein a plurality of main burners are arranged around the pilot fuel nozzle with respect to the radial direction, wherein the pilot cone is arranged on the pilot fuel nozzle at a combustion chamber end and having an opening at the combustion chamber end, such that a pilot flame is formed in the pilot cone by mixing air and pilot fuel in order to ignite a fuel injected by the plurality of main burners, wherein the pilot cone includes a plurality of turbulence generators on its inner side and/or its outer side, wherein the plurality of turbulence generators are trapezoidal and/or triangular strips which are arranged at an opening of the pilot cone over the entire circumference of the opening of the pilot cone, and wherein the trapezoidal and/or triangular strips are arranged on the pilot cone alternately at an angle of +/−30°.

2. The gas turbine combustion chamber as claimed in claim 1, wherein the gas turbine combustion chamber has an axial direction and each main burner includes a plurality of main nozzles and an outer cylinder arranged with a gap around the outer circumference of the respective main nozzle, wherein a plurality of extension tubes are embodied in such a way that they extend a plurality of openings of the outer cylinder, whereby the plurality of extension tubes have a radial taper and widen out in the circumferential direction, so that each extension tube merges into the adjacent extension tube, so as to produce an annular main nozzle opening which is extended in the axial direction up to the opening of the pilot cone, and wherein the plurality of turbulence generators are arranged on the inner side of the annular main nozzle opening.

3. The gas turbine combustion chamber as claimed in claim 1, wherein the gas turbine combustion chamber has an axial direction and each main burner includes a plurality of main nozzles and an outer cylinder arranged with a gap around the outer circumference of the respective main nozzle, and wherein a plurality of extension tubes are embodied with an outlet opening at the combustion chamber end in such a way that they extend the openings of the outer cylinder in the axial direction up to the opening of the pilot cone, and wherein a plurality of turbulence generators are arranged on one inner side of the extension tubes in the area of the outlet opening.

4. A gas turbine combustion chamber, comprising:

a pilot fuel nozzle which is arranged in the central section of a cylinder, which opens at one end towards a combustion chamber, comprising:

a fuel nozzle and a cylindrical casing around the outer circumference of the fuel nozzle and at a radial distance therefrom, a pilot swirl element is arranged between fuel nozzle and outer casing, a pilot cone having an inner side and outer side, wherein the pilot cone is arranged on the pilot fuel nozzle at the combustion chamber end and having an opening at the combustion chamber end, so that a pilot flame is formed in the pilot cone by mixing air and pilot fuel in order to ignite a fuel injected by the main burners, wherein a plurality of main burners are arranged around the pilot fuel nozzle with respect to the radial direction, wherein the pilot cone includes a plurality of turbulence generators on its inner side and/or outer side, wherein the gas turbine combustion chamber has an axial direction and each main burner has a plurality of main nozzles and an outer cylinder arranged with a gap around the outer circumference of the respective main nozzle, wherein the plurality of extension tubes are embodied in such a way that they extend the openings of the outer cylinder, that is to say the plurality of extension tubes have a radial taper and open out in the circumferential direction, so that each extension tube merges with the adjacent extension tube, so as to produce an annular main nozzle opening which extends in an axial direction up to the opening of the pilot cone, and wherein a plurality of turbulence generators are arranged on the inner side of the annular main nozzle opening.

5. The gas turbine combustion chamber, comprising:

a pilot fuel nozzle which is arranged in the central section of a cylinder, which opens at one end towards a combustion chamber, comprising, a fuel nozzle and a cylindrical outer casing around the outer circumference of the fuel nozzle and at a radial distance therefrom, and a pilot swirl element is arranged between fuel nozzle and outer casing, a pilot cone having an inner side and outer side, wherein the pilot cone is arranged on the pilot fuel nozzle at the combustion chamber end and having an opening at the combustion chamber end, so that a pilot flame is formed in the pilot cone by mixing air and pilot fuel in order to ignite a fuel injected by the main burners, wherein a plurality of main burners which is arranged around the pilot fuel nozzle with respect to the radial direction, wherein the pilot cone includes a plurality of turbulence generators at its inner side and/or outer side, wherein the gas turbine combustion chamber has an axial direction and each main burner has a plurality of main nozzles and an outer cylinder arranged with a gap around the outer circumference of the respective main nozzle, and wherein a plurality of extension tubes are embodied with an outlet opening at the combustion chamber end in such a way that they extend the openings of the outer cylinder in the axial direction up to the opening of the pilot cone, and wherein a plurality of turbulence generators are arranged on an inner side of the extension tubes in the area of the outlet opening.

* * * * *